US005692581A

United States Patent [19]

Nelson et al.

[11] Patent Number: 5,692,581

[45] Date of Patent: Dec. 2, 1997

[54] ANTI-SLIP DEVICE FOR LADDER RUNGS

[76] Inventors: John Robert Nelson, 3, Lorong Galing 71, Taman Air Putin, 25300 Kuantan; Richard Forbes Donald-Hill, #A 2350, Jalan Kubang Buaya, 25250 Kuantan, both of Pahang, Malaysia

[21] Appl. No.: 541,908

[22] Filed: Oct. 10, 1995

[30] Foreign Application Priority Data

Aug. 7, 1995 [MY] Malaysia ..... PI 9502303

[51] Int. Cl.[6] ..... E06C 1/00

[52] U.S. Cl. ..... 182/129; 182/151; 182/194; 182/230; 248/687; 248/210

[58] Field of Search ..... 182/129, 151, 182/194, 230, 107, 108; 248/210, 214, 687

[56] References Cited

U.S. PATENT DOCUMENTS

| | | | |
|---|---|---|---|
| 2,518,107 | 8/1950 | Wilson | 182/129 X |
| 3,037,579 | 6/1962 | Barrow | 182/107 |
| 3,422,923 | 1/1969 | Lund | 182/129 X |
| 3,780,828 | 12/1973 | Overturf | 182/111 |
| 3,828,792 | 8/1974 | Valenta | 128/619 |
| 4,151,320 | 4/1979 | Naka | 428/163 |
| 4,469,194 | 9/1984 | McBride | 182/107 |
| 4,600,079 | 7/1986 | McBride | 182/108 |
| 4,778,032 | 10/1988 | Takahashi | 182/129 X |
| 5,060,755 | 10/1991 | Bourdages et al. | 182/121 |
| 5,060,757 | 10/1991 | Wyche | 182/194 X |
| 5,103,608 | 4/1992 | Andreo | 52/179 |
| 5,117,941 | 6/1992 | Gruber | 182/107 |
| 5,131,495 | 7/1992 | Bartnicki | 182/124 |
| 5,137,114 | 8/1992 | Yde | 182/49 |
| 5,139,108 | 8/1992 | Pate | 182/129 |
| 5,141,076 | 8/1992 | Joyce | 182/108 |
| 5,141,294 | 8/1992 | Van Zanten | 303/109 |
| 5,152,245 | 10/1992 | Olsen | 114/362 |
| 5,154,255 | 10/1992 | Kiska | 182/111 |
| 5,165,641 | 11/1992 | Southern | 248/230 |
| 5,181,584 | 1/1993 | Simaro | 182/201 |
| 5,269,544 | 12/1993 | Park | 280/5.24 |
| 5,316,409 | 5/1994 | Aune | 405/1 |
| 5,339,921 | 8/1994 | Faupel | 182/111 |
| 5,341,899 | 8/1994 | Casamerto | 182/205 |
| 5,361,868 | 11/1994 | Bartos | 182/111 |
| 5,377,375 | 1/1995 | Holman | 15/49.1 |
| 5,377,623 | 1/1995 | Parr | 119/221 |
| 5,484,036 | 1/1996 | Cothern | 182/107 |

*Primary Examiner*—Ramon O. Ramirez
*Assistant Examiner*—Brian J. Hamilla
*Attorney, Agent, or Firm*—Ladas & Parry

[57] ABSTRACT

A cover for a rung of a ladder consisting of an elongate member (12) configured to spring clamp over the rung of the ladder and a layer (16) of anti-skid or anti-slip material removeably fastened to the external surface of the cover. The elongate member includes at least one aperture (13) at each terminal end to receive a bolt for fastening the elongate member to the rung of the ladder.

13 Claims, 2 Drawing Sheets

ANTI-SLIP DEVICE FOR LADDER RUNGS

FIELD OF THE INVENTION

The present invention relates to an anti-slip device for ladder rungs and in particular relates to an anti-slip device which is detachably fastenable to rungs of ladders and/or hand rails of ladders, staircases and the like.

BACKGROUND OF THE INVENTION

Ladder rungs often become slippery due to moisture or the gradual deposition of oil, grease and chemicals. This coating can become a safety hazard, heightening the risk of personnel injuries. Various means have been employed to maintain ladder rungs slip resistant. One of the ways has been to provide ribbed, grated ladder rungs. Another way has been to glue on non-slip sheets of material onto the ladder rungs. In some prior art applications, the rung has to be grounded or sandblasted prior to application of epoxy glue for the fastening of sheets of anti-slip material. If the sheet of nonslip material is to be fastened to already used/installed ladder rungs, then the ladder rungs have to be degreased before the application of glue or the fastening of anti-slip sheets of material. These preparatory activities are not only costly, but time consuming and can be hazardous in certain environment where there is danger of fire or explosion.

SUMMARY OF THE INVENTION

Therefore it is an object of the present invention to provide a non-slip device for rungs of ladders which overcomes the disadvantages in the prior art devices.

It is another object of the invention to provide a non-slip device which can be easily installed on rungs of ladders or stair rails, or guides, regardless of whether the rungs, rails or guides are formed of wood, steel, aluminium or plastics or any other rigid material.

It is another object of the invention to provide a non-slip device for ladder rungs, staircase guide rails and the like where it is not essential that the structures be cleaned or degreased before the anti-slip device is fastened.

The invention discloses a cover for a rung of a ladder where the cover consists of an elongate member configured to spring clamp over the rung of a ladder and a layer of anti-skid or anti-slip material detachably fastenable to the external surface of the cover. The elongate member includes an aperture at each end to facilitate the fastening of the elongate member to the rung of the ladder by nut and bolt means.

In another aspect the elongate member can be selected from a substantially rigid material, such as steel, iron, aluminium, plastics, etc.

The acompanying drawings, which are incorporated and constitute a part of the specification; illustrate preferred embodiments of the invention, and together with the description serve to explain the principles of the invention.

DESCRIPTION OF THE PREFERRED EMBODIMENTS

Figure 1:
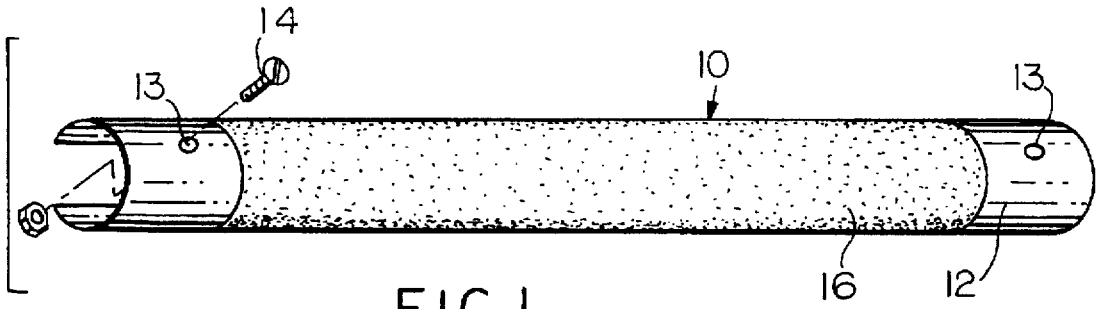
FIG. 1 is a perspective view of a preferred embodiment of the ladder rung cover.
Figure 2:
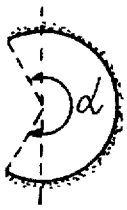
FIG. 2 is a cross-sectional view of the cover of shown in FIG. 1
Figure 3:
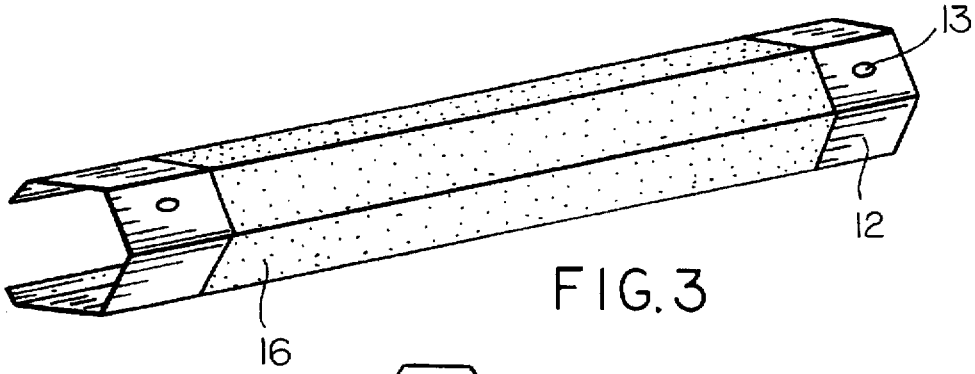
FIG. 3 is a perspective view of another embodiment of the cover.
Figure 4:
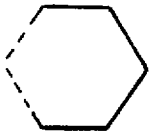
FIG. 4 is a cross-sectional view of the cover shown in FIG. 3.
Figure 5:
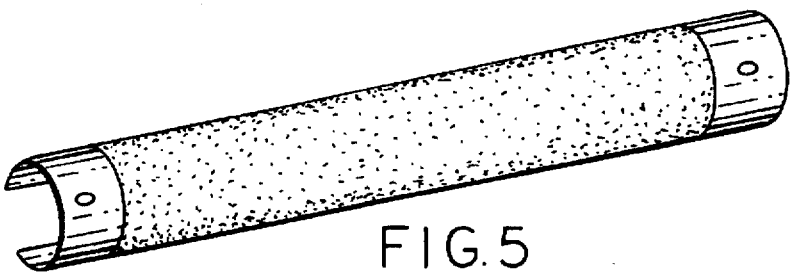
FIG. 5 is a perspective view of another embodiment of the cover which is oval in cross-sectional view.

Referring to FIGS. 1–2 there is illustrated an elongate arcuate cross-sectioned ladder rung cover (10). The ladder rung cover consists of an elongate hollow metal bar (12), whose cross-section is configured and dimensioned to provide a spring clamping effect on an existing ladder rung. To further secure the rung cover (10) on the ladder rung (18) and to prevent the rung cover from rotating about the ladder rung the two ends of the rung cover are secured to the ladder rungs by nut and bolts. The internal diameter of the rung cover is marginally larger than the external diameter of the ladder rung and is cross-sectioned such that the angle forming by the two radii of the arcuate section ($\alpha$) is greater than 180°.

Where the ladder rung is of other cross-sectional shape, such as oval or hexagonal (FIG. 3, 4, 5) than the rung cover is also configured and dimensioned to provide a spring clamping effect. Apertures (13) are provided at both the terminal ends. The rung cover is removably secured to the ladder rungs by nut and bolt means (14) inserted through apertures (13).

Figure 6:
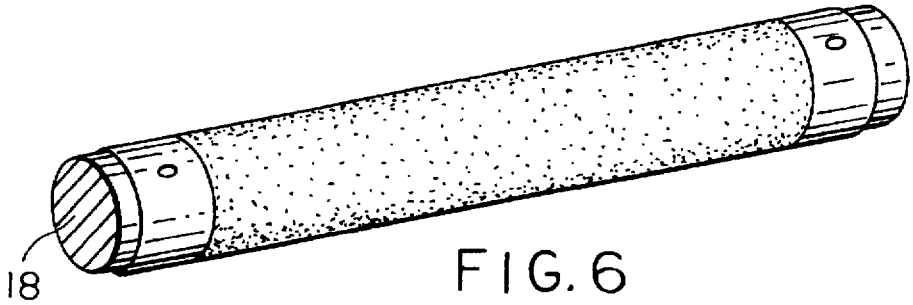
FIG. 6 is a perspective view of the cover in FIG. 1 detachably fastened to a ladder rung.
Figure 7:
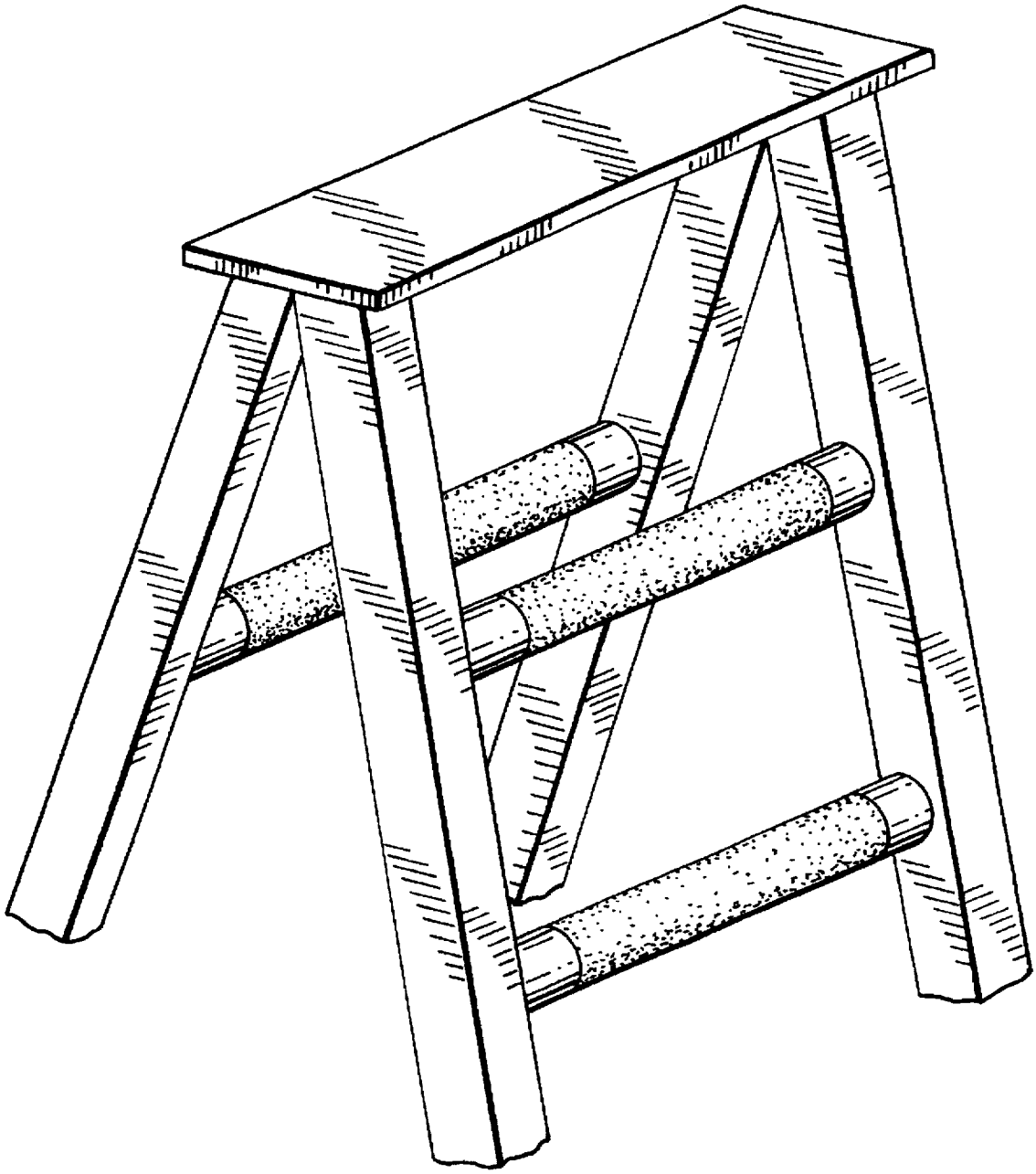
FIG. 7 is a perspective view of a ladder having a plurality of rungs having respective covers of the type shown in FIG. 1 secured thereto.

FIG. 6 illustrates the rung cover secured to a rung of a ladder. FIG. 7 illustrates ladder (20) having a plurality of rungs to which rung covers are respectively secured.

The rung cover includes a layer (16) of anti-slip material having an adhesive backing which layer is affixed to the outer surface of the rung cover. Preferably the anti-slip layer (16) is brightly coloured or luminescent to enhance safety features. One such layer of material is marketed by the 3M Company. The anti-slip layer is made from wear resistant components. Preferably, the anti-slip layer consists of anti-slip material affixed to the upper surface of a sheet of base material.

It will be appreciated that the ladder rung cover is of two-part construction and is configured to achieve specific advantages when the anti-slip or anti-skid layer of material is worn out or clogged, the layer can be removed and replaced quickly with another identical or similar layer. When the ladder rung cover (12) is worn out, it can be easily removed from the ladder rung by disengaging the nuts and bolts. A replacement ladder rung cover can be installed, with or without a pre-affixed layer of anti-slip material on the rung. The anti-slip material can be affixed to the elongate member of the replacement rung cover later on site.

As the ladder rung cover (12) is non-load bearing, it can be conveniently made of a appropriate rigid material, such as aluminium, brass, or even a rigid plastics material or other composite material.

In a preferred embodiment of the invention, a ladder rung is covered by a plurality of ladder rung covers similar to those described above except that each ladder rung cover is of shorter length and the individual covers are positioned end to end on the rung. This is to provide cost effective replacement of the ladder rung cover on a portion of the rung that receives greater wear and tear than the rest of the rung. Typically the mid-section of the ladder rung cover wears off more rapidly than the end portions. Therefore a single ladder rung cover including a layer of anti-slip material can be affixed to the mid-section of the ladder rung, the anti-slip layer or the entire cover being replaceable. The end regions of the ladder rung can be fitted with separate ladder rung covers positioned on either side of the mid-section cover.

We claim:

1. An anti-slip cover for an individual rung of a ladder which comprises an elongate member made of a substantially rigid material and having a cross-section configured to cover greater than one-half the circumference of the rung without completely surrounding the rung, and said member having an internal diameter which is marginally larger than the external diameter of the rung and being sufficiently resilient so as to spring clamp over said rung, and a layer of one of an anti-skid and anti-slip material dimensioned so as to cover a substantial portion of the outer surface of the elongate member, and having an adhesive applied to the lower surface of the layer of one of the anti-skid and anti-slip material for affixing the layer to the elongate member but permitting removal from the elongate member when desired.

2. The anti-slip cover as claimed in claim 1, wherein the elongate member includes an aperture at each end to facilitate the fastening of the elongate member to the rung of the ladder by nut and bolt means inserted through the apertures and into the rung.

3. The anti-slip cover as claimed in claim 2, wherein the rigid material is steel.

4. The anti-slip cover as claimed in claim 2, wherein the rigid material is plastics material.

5. The anti-slip cover as claimed in claim 1, wherein the rigid material is steel.

6. The anti-slip cover as claimed in claim 1, wherein the rigid material is plastics material.

7. The anti-slip cover as claimed in claim 1, wherein the layer of one of the anti-skid and anti-slip material comprises a wear resistant material secured to an upper surface of a sheet of base material.

8. The combination of a rung of a ladder and the anti-slip cover for the rung as claimed in claim 1.

9. The combination of a ladder having a plurality of rungs and a plurality of anti-slip covers as claimed in claim 1 detachably fastened to the rungs.

10. The anti-slip cover as claimed in claim 1, wherein the elongate member is arcuate in cross-section.

11. The anti-slip cover as claimed in claim 1, wherein the elongate member is hexagonal is cross-section.

12. The anti-slip cover as claimed in claim 1, wherein the elongate member is oval in cross-section.

13. The anti-slip cover as claimed in claim 1, wherein the layer of one of the anti-skid and anti-slip material is spaced from terminal ends of the elongate member but is dimensioned to extend substantially over the entire circumference of the elongate member.

* * * * *